US009212496B2

(12) United States Patent
Drechsel et al.

(10) Patent No.: US 9,212,496 B2
(45) Date of Patent: Dec. 15, 2015

(54) ANTI-CORROSION POOL COVER ASSEMBLIES

(71) Applicant: Cover-Pools Incorporated, Salt Lake City, UT (US)

(72) Inventors: Lamont Alan Drechsel, Salt Lake City, UT (US); Nathan James Dewyea, Draper, UT (US)

(73) Assignee: COVER-POOLS INCORPORATED, Salt Lake City, UT (US)

( * ) Notice: Subject to any disclaimer, the term of this patent is extended or adjusted under 35 U.S.C. 154(b) by 277 days.

(21) Appl. No.: 13/773,774

(22) Filed: Feb. 22, 2013

(65) Prior Publication Data

US 2013/0212797 A1 Aug. 22, 2013

Related U.S. Application Data

(60) Provisional application No. 61/601,590, filed on Feb. 22, 2012.

(51) Int. Cl.
*E04H 4/00* (2006.01)
*E04H 4/14* (2006.01)
*E04H 4/10* (2006.01)

(52) U.S. Cl.
CPC .. *E04H 4/14* (2013.01); *E04H 4/00* (2013.01); *E04H 4/101* (2013.01)

(58) Field of Classification Search
CPC ..... E04H 4/084
USPC ..... 4/488–513; 242/596.7, 600
See application file for complete search history.

(56) References Cited

U.S. PATENT DOCUMENTS

| | | | | |
|---|---|---|---|---|
| 5,036,606 | A * | 8/1991 | Erich et al. | 36/134 |
| 5,184,356 | A * | 2/1993 | Lof et al. | 4/502 |
| 5,321,901 | A * | 6/1994 | Kelly | 36/134 |
| 5,425,143 | A * | 6/1995 | Kalandovsky | 4/502 |
| 5,913,613 | A * | 6/1999 | Ragsdale et al. | 4/502 |
| 5,920,922 | A * | 7/1999 | Ragsdale et al. | 4/502 |
| 6,810,608 | B2 * | 11/2004 | Kelly | 36/134 |
| 7,107,708 | B2 * | 9/2006 | Kelly et al. | 36/134 |
| RE40,460 | E * | 8/2008 | Savoie | 36/134 |
| 7,891,118 | B2 * | 2/2011 | Chen et al. | 36/67 D |
| 8,006,409 | B2 * | 8/2011 | Chen et al. | 36/67 D |
| 8,201,348 | B2 * | 6/2012 | Kelly | 36/134 |
| 8,844,169 | B1 * | 9/2014 | Savoie | 36/67 R |
| 2002/0152643 | A1 * | 10/2002 | Kim | 36/127 |
| 2004/0031171 | A1 * | 2/2004 | Chen | 36/134 |
| 2005/0000119 | A1 * | 1/2005 | McMullin | 36/134 |
| 2006/0005431 | A1 * | 1/2006 | Savoie | 36/134 |
| 2006/0059723 | A1 * | 3/2006 | Robinson et al. | 36/127 |
| 2006/0112598 | A1 * | 6/2006 | Savoie | 36/134 |
| 2008/0196276 | A1 * | 8/2008 | McMullin | 36/127 |
| 2009/0223088 | A1 * | 9/2009 | Krikorian et al. | 36/127 |
| 2009/0229147 | A1 * | 9/2009 | McMullin | 36/134 |
| 2010/0186262 | A1 * | 7/2010 | Krikorian et al. | 36/134 |

* cited by examiner

*Primary Examiner* — Lori Baker
(74) *Attorney, Agent, or Firm* — Dean W. Russell; Kristin M. Crall; Kilpatrick Townsend & Stockton LLP

(57) ABSTRACT

Pool cover components that are more resistant to corrosion than current cover assemblies and polymer hubs that separate potentially corrosive-prone components from one another. The polymer hubs isolate dissimilar metals, preventing them from conducting electricity and speeding the corrosion process. There may be a coating on one or more of the components to prevent electrical conductivity.

14 Claims, 6 Drawing Sheets

ANTI-CORROSION POOL COVER ASSEMBLIES

CROSS REFERENCE TO RELATED APPLICATIONS

This application claims the benefit of U.S. Provisional Application Ser. No. 61/601,590, filed Feb. 22, 2012, titled "Components of Cover Assemblies for Pools and Spas," the entire contents of which are hereby incorporated by reference.

FIELD OF THE INVENTION

Embodiments of the present invention relate generally to pool cover components that are more resistant to corrosion than current cover assemblies. Certain embodiments provide polymer hubs that separate potentially corrosive-prone components from one another. Other embodiments provide a coating on one or more of the components to prevent electrical conductivity, which often leads to corrosion of certain metals.

BACKGROUND

The water in pools and spas must be treated in order to prevent growth of algae or bacteria that may flourish in large bodies of untreated water. Many pools and spas are treated by traditional chlorination sanitation—direct addition of chlorine to the water. However, more and more pools and spas are being installed or retrofitted with salt water chlorinators. Salt water chlorinators use dissolved salt (NaCl) as a store for the chlorination system. The chlorinator uses electrolysis to break down the salt into its individual elements, one of which is chlorine. The resulting chemical reaction eventually produces hypochlorous acid (HClO), and sodium hypochlorite (NaClO), which are the sanitizing agents already commonly used in swimming pools. As such, a saltwater chlorination system utilizes a chlorine generator instead of direct addition of chlorine.

One of the benefits of a salt chlorination system in a pool or spa is the convenient and constant delivery of pure chlorine-based sanitizer. Such systems help eliminate chloramines, which are the irritants that give traditional pools their caustic smell and can cause burning eyes for swimmers. Salt chlorination systems use electrolysis, which burns off the chloramines in the same manner as traditional shock (oxidizer) and reduces dissolved alkali minerals in the water. However, there are also some disadvantages to the use of salt water chlorination systems, one of which is that salt conducts electricity, which can cause galvanic corrosion.

When salt is in the presence of two dissimilar metals, it can turn the system into a battery of sorts, with one of the electrodes giving off an electron which creates corrosion. This corrosion increases when there is liquid in the "battery," such that adding salt to a pool system creates an electrolyte of sorts (e.g., when the salt is dissolved in a solvent (e.g. water), it becomes an electrolyte with free ions). This corrosion can damage some metals, as well as stone or other pool decking materials. Many pool equipment manufacturers will not warranty stainless steel products damaged by saline pools.

There is thus a need to provide protective features for various components to be used in connection with salt water pools, particularly those components that come into contact with the water on a recurring basis. For example, some mechanical systems that may be used in connection with pools and spas are pool cover systems, which can be activated to roll a cover across a pool or spa surface for protection, money savings, and/or safety reasons. Pool covers can save pool owners money by saving on heat, chemicals, equipment and pool cleaning, and other operating costs; they can save lives by providing a safeguard against accidental pool entry by an unattended child; they can save time by keeping dirt, leaves and other debris out of the pool when the pool is covered; and they can save energy by reducing heating costs. However, if the pool cover extension and retraction system components become corroded, this can damage the ability of the system to work properly. Accordingly, improvements to pool cover assembly components are needed in order to help ensure that they remain corrosion-free, even when used in connection with a salt water pool.

BRIEF SUMMARY

Embodiments of the invention described herein thus provide pool cover components that are more resistant to corrosion than current cover assemblies. Certain embodiments provide polymer hubs that separate potentially corrosion-prone components from one another. The polymer hubs isolate dissimilar metals, preventing them from conducting electricity and speeding the corrosion process. Other embodiments provide a coating on one or more of the components to prevent electrical conductivity.

DETAILED DESCRIPTION

Embodiments of the present invention provide covers for pools that are designed and manufactured having certain features that render the pool cover systems and assemblies more corrosion resistant than current pool cover assemblies. The new designs provided help to resist galvanic corrosion or otherwise inhibit degradation of the components.

Figures 1, 2:
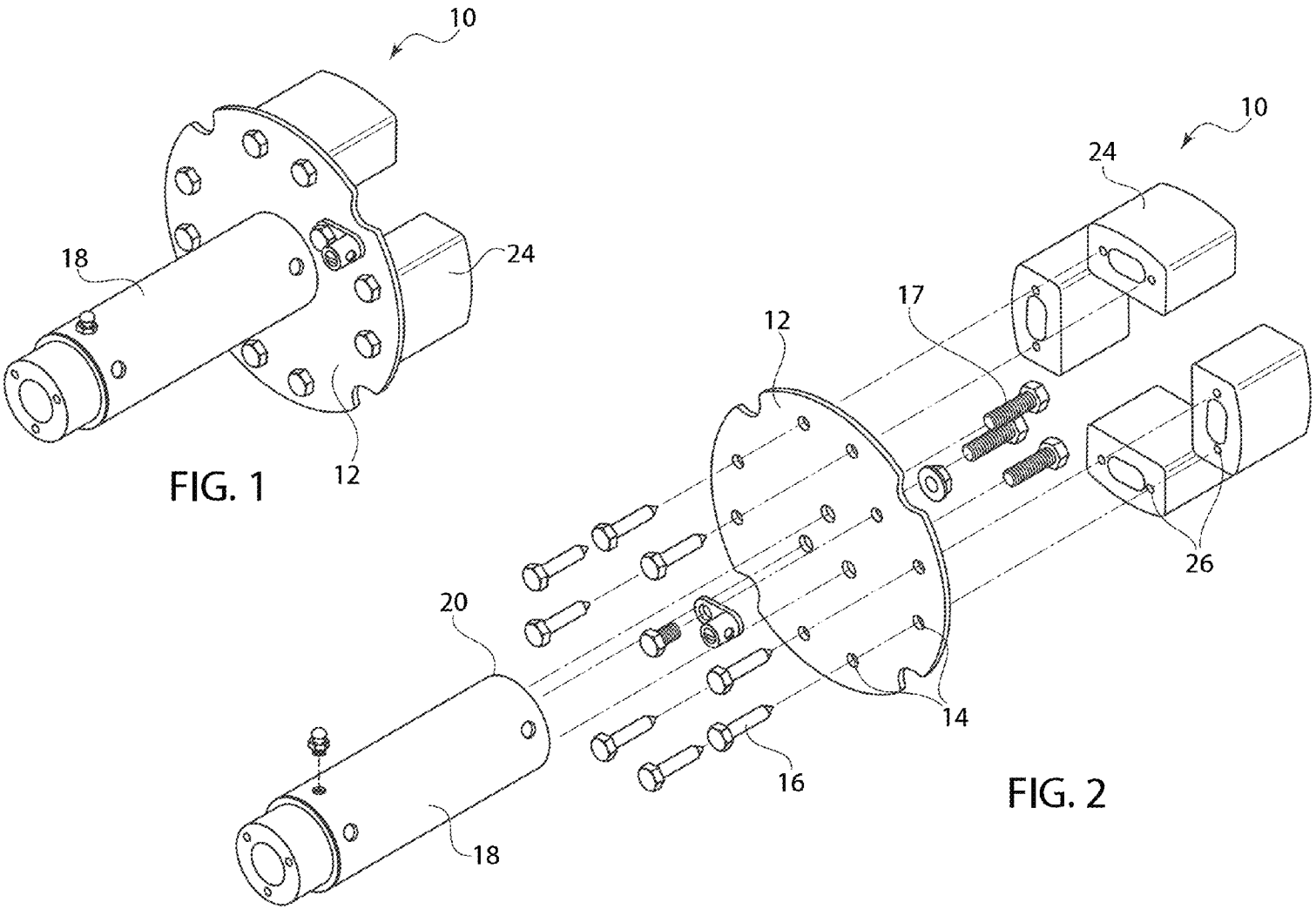
FIG. 1 shows a side perspective view of a hub assembly for a pool cover system according to one embodiment of the invention.
FIG. 2 shows an exploded perspective view of the hub assembly of FIG. 1.
Figure 3:
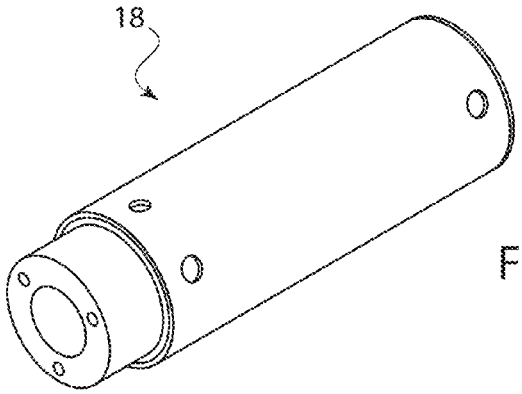
FIG. 3 shows a side perspective view of a hub stem for a pool cover system according to one embodiment of the invention.
Figure 4:
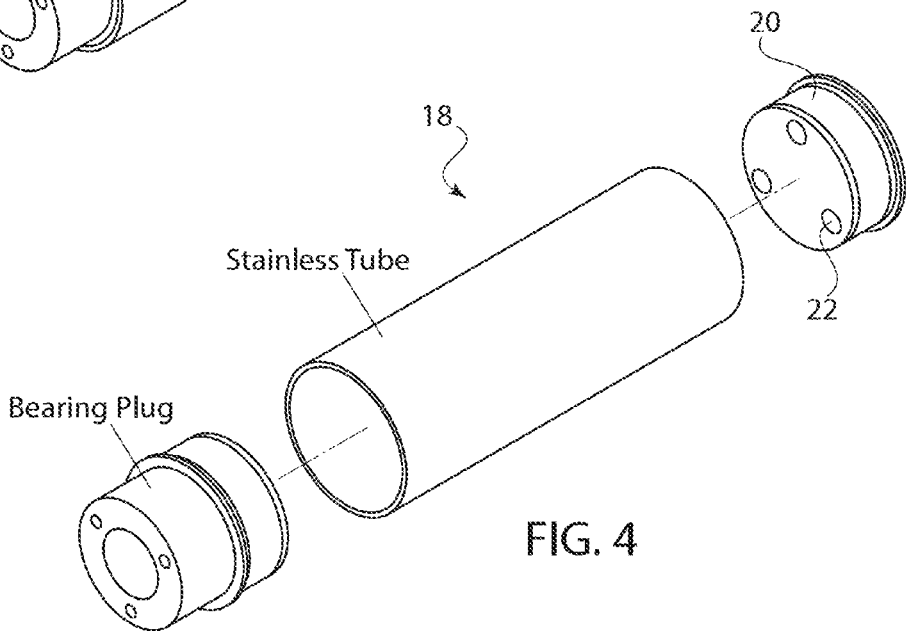
FIG. 4 shows an exploded perspective view of the hub stem of FIG. 3.

FIGS. 1 and 2 show an embodiment of a redesigned end hub assembly 10 for use with a pool cover assembly. The hub assembly 10 has a central plate 12 with a series of openings 14 therethrough. The openings 14 are configured to receive fastening features 16 that secure a hub stem 18 to the plate 12 on one side of the plate 12. The hub stem 18 is shown in more detail in FIGS. 3 and 4. FIG. 4 particularly illustrates the end plug 20, which has bolt holes 22. When end plug 20 is in place and secured to the end of hub stem 18, one or more fasteners or bolts 17 may be positioned through one of the bolt holes 22 and through one of the plate openings 14 in order to secure the hub stem to the plate. The bolt holes may be threaded in order to more fully secure a threaded bolt in place, but not required. FIG. 2 shows three bolts 17 used to secure the hub stem 18 in place to the plate 12, but more or fewer bolts may be used.

Figure 8:
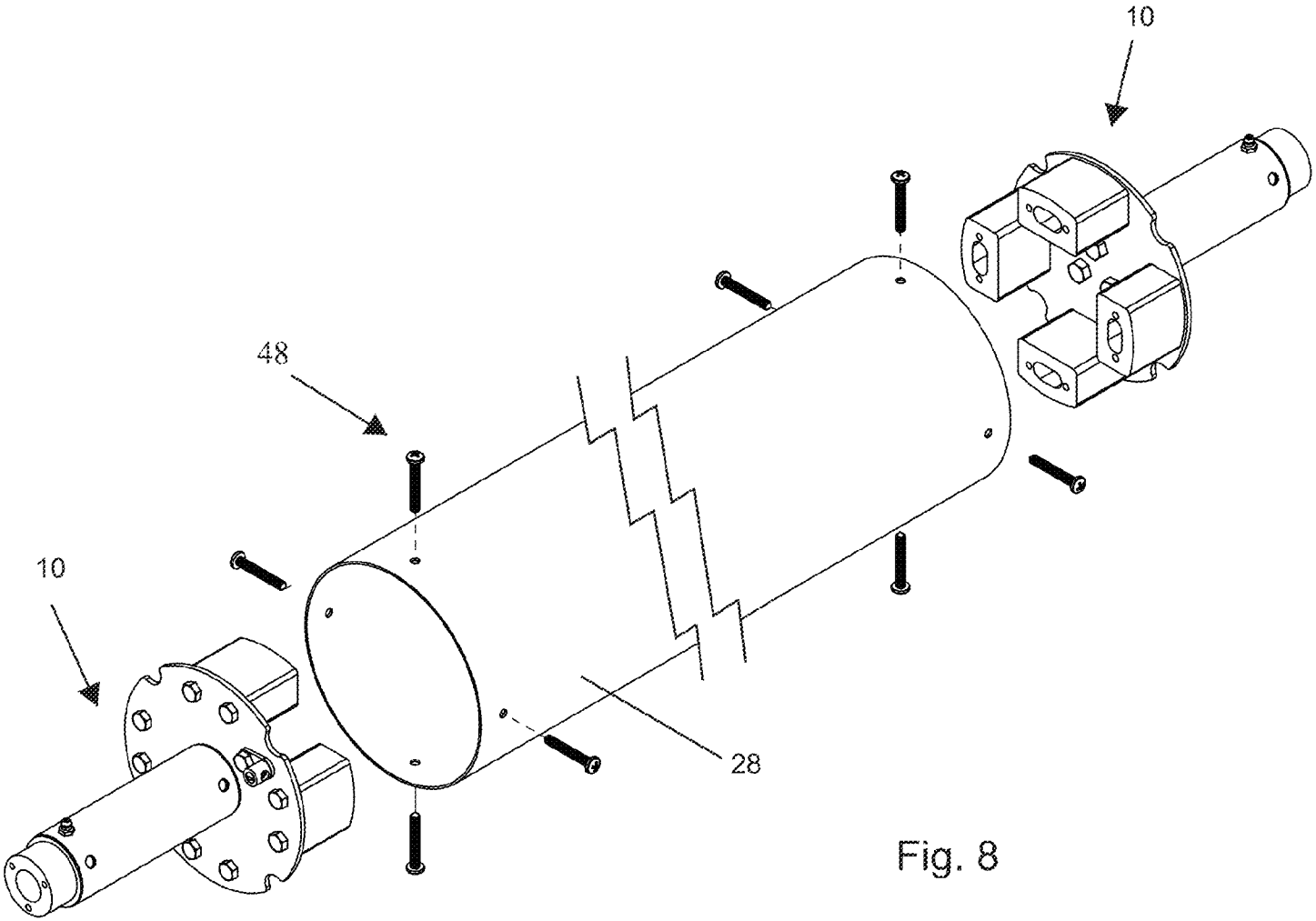
FIG. 8 shows an exploded perspective view of two hub stems in cooperation with a tube.
Figure 9:
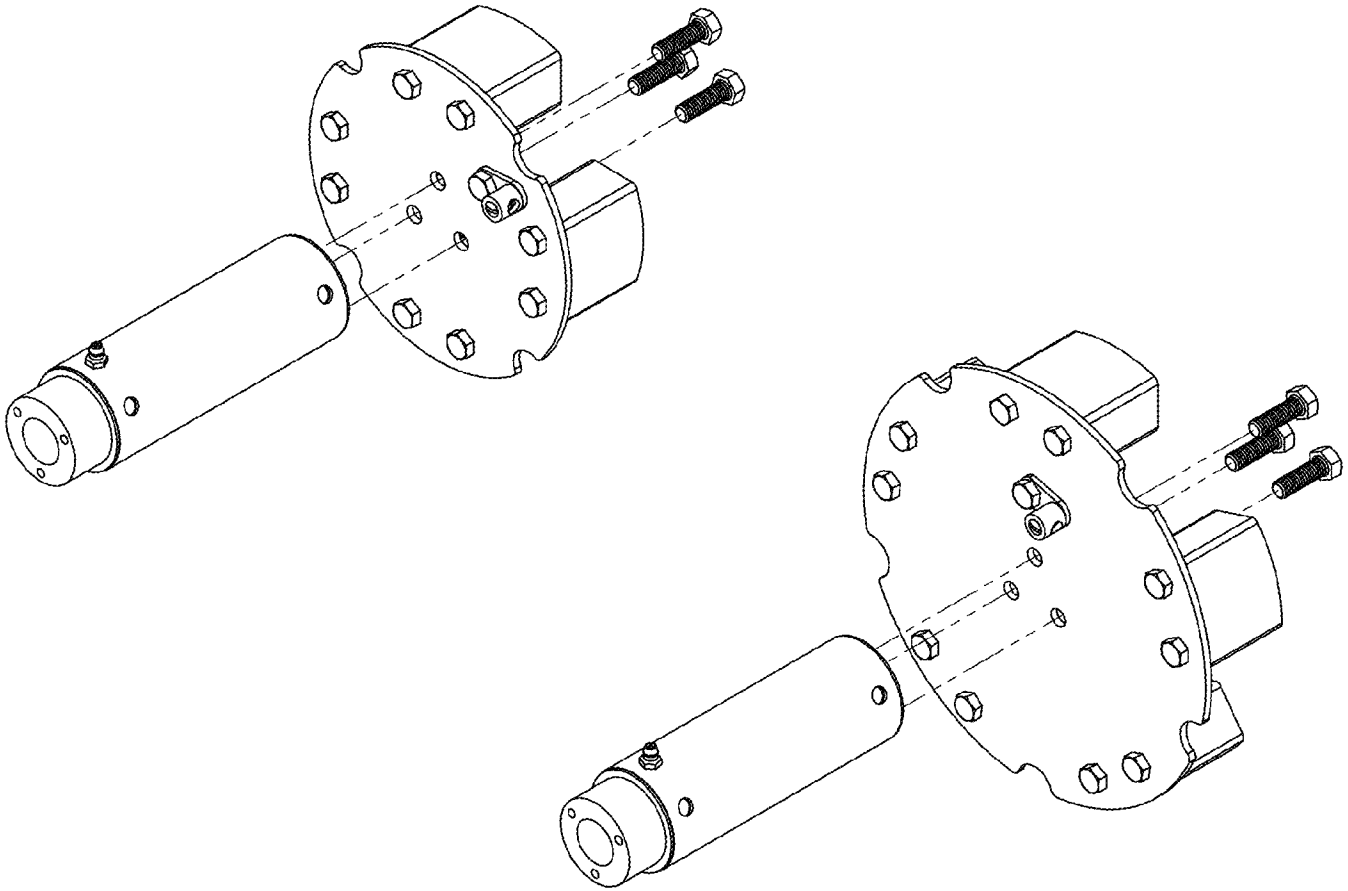
FIG. 9 shows optional plate interchangeability.

Both the central plate 12 and the hub stem 18 are provided as discrete elements, rather than as a unitary piece. It has been found that by providing these elements as separate components, greater interchangeability options may be provided, as shown in FIG. 9. For example, this configuration allows the same hub to be used with different sized plates. For example, a single hub stem need only be manufactured, but it could be secured to either a 6" plate or to an 8" plate, as desired. (As described below and as shown in FIG. 8, the hub assemblies 10 cooperate with a tube 28 in use. In specific embodiments, there are provided 6" and 8" tubes. By providing the hub stem and plates as separate components, switching out to a larger plate allows the system to be adapted such that the hub assembly now fits a larger size tube instead of creating an entirely new hub.) Additionally, creating a unitary hub assembly out of cast aluminum is more efficient from a manufacturing perspective than creating a unitary hub assembly out of stainless steel. Accordingly, the two piece configuration shown and described also eases manufacturing steps and can lower costs.

Both the central plate 12 and the hub stem 18 are manufactured of stainless steel, which does not corrode as easily as cast (or billet) aluminum, the material commonly used in the pool industry for these elements. An aluminum on aluminum configuration creates corrosion, even when the aluminum is anodized or powder coated, primarily because cast aluminum is more porous than stainless steel and the anodized portions or powder coating can flake. Accordingly, providing these cover components 12, 18 out of stainless steel or another metal that is less prone to corrosion reduces corrosion issues, and is an advancement over the current technology. Specifically, both steel and aluminum react with oxygen to form a passivation layer that protects the underlying metal. That layer is aluminum oxide for aluminum and chromium oxide for stainless steel. Depending on the alloys and the manufacturing process used, stainless steel is usually significantly more resistant to corrosion. Accordingly, using stainless steel parts to replace cast aluminum parts significantly eases these problems. (Depending on their relative locations on the anodic index, some dissimilar metals can be joined without increasing corrosion; however, when stainless steel contacts aluminum, it acts as a cathode and aluminum as an anode, which causes the aluminum to corrode as it gives up electrons.) Accordingly, by creating methods to keep these two metals from ever making contact in the updated design, many of the corrosion problems of the prior art are reduced or eliminated.

Another factor that also reduces corrosion problems is the use of polymer hubs 24 secured on the other side of the central plate 12. The polymer hubs 24 insulate dissimilar metals (e.g., the stainless steel end hub and the aluminum drum, described in more detail below) from one another. The polymer hubs 24 are raised elements of a polymer, plastic, or rubber-like material that are secured to central plate 12. As shown in FIG. 2, the hubs 24 have at least one opening 26 therethrough, and may have more than one opening, in various sizes. The at least one opening 26 is provided to receive one or more fastener features 16, which may be a threaded or non-threaded fastener feature 16. As shown in FIG. 2, two fasteners are used per hub 24, but more or fewer fasteners may be used. The completed end hub assembly 10 is shown in FIG. 1. The hubs 24 isolate the stainless steel plate 12 from other dissimilar metals in the system.

In use, two completed hub assemblies 10 cooperate on either end of a tube 28 in order to create a drum assembly 48, as shown in FIG. 8, on which a fabric pool cover may be mounted and rolled. By its very nature, this drum assembly 48 gets wet when the pool cover is rolled onto the drum 48. Accordingly, the anti-corrosion features described herein are necessary for preventing corrosion that can occur if the water contains salt from the salt water chlorinator.

Figure 5:
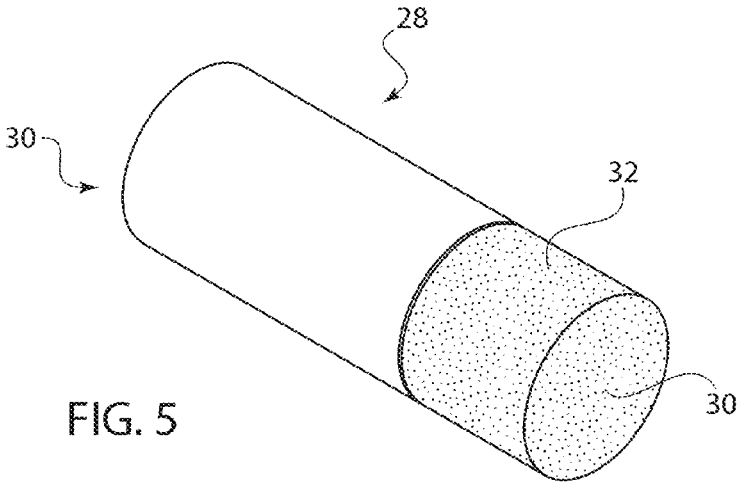
FIG. 5 shows a side perspective view of a tube having a coating according to one embodiment of the invention.

An example of a tube 28 that forms the drum 48 is shown in FIG. 5. The polymer hubs 24 of the hub assembly 10 are inserted into the openings 30 of the tube 28. In one embodiment, the tube 28 is constructed of aluminum (due to its lighter weight) and is coated with a polyurethane coating 32 that may be sprayed or dipped onto the tube 28. Another material may be used instead; the general purpose of coating 32 is to limit electrical conductivity of the tube. For example, the coating 32 may be a rubber coating, a polyurethane coating, any other appropriate coating, or any combination thereof. The coating 32 may be applied to the inside and outside of the tube 28, which helps limit the aluminum tube's interaction with the stainless steel plate 12 in use. Coating may be provided only at the ends of the tube, for example, at the last approximate six inches of the rollup drum tube 28, in order to protect the area where the drum assembly 48 interfaces with the end hub. (Only one end of the tube 28 is shown, as the tube can be quote long, and it should be understood that both ends may be coated.) Alternatively, it is possible to coat the entire tube or a more substantial portion of the tube 28. This coating 32 provides an additional layer to isolate the dissimilar metals. Thus, there are two degrees of protection provided—one degree is provided by the polymer hubs 24, which isolate the stainless steel central plate 12 from the aluminum tube 28, and a second degree is provided by the optional coating 32 on the aluminum tube 28. It is possible to use these two features together in one system, or to use only one feature (such as providing a drum assembly with polymer hubs 24 cooperating with an uncoated tube or to provide a drum assembly without polymer hubs, but with hub assemblies that cooperate with a coated tube 28). In many instances, the coated tube may generally be considered as an upgrade option for use with the polymer hubs.

Figures 6, 7:
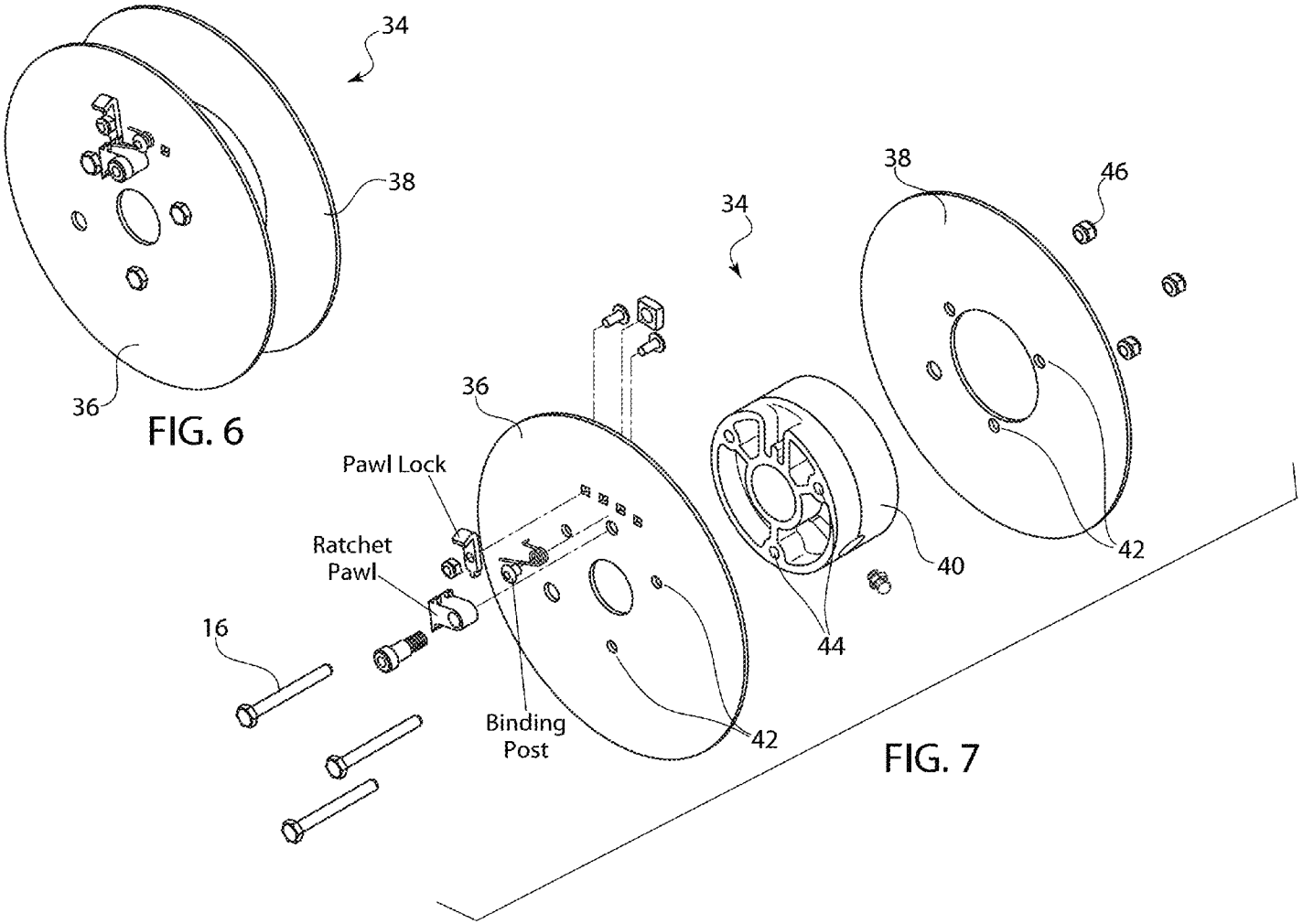
FIG. 6 shows a side perspective view of a rope reel for a pool cover system according to one embodiment of the invention.
FIG. 7 shows an exploded perspective view of the rope reel of FIG. 6.
Figure 10:
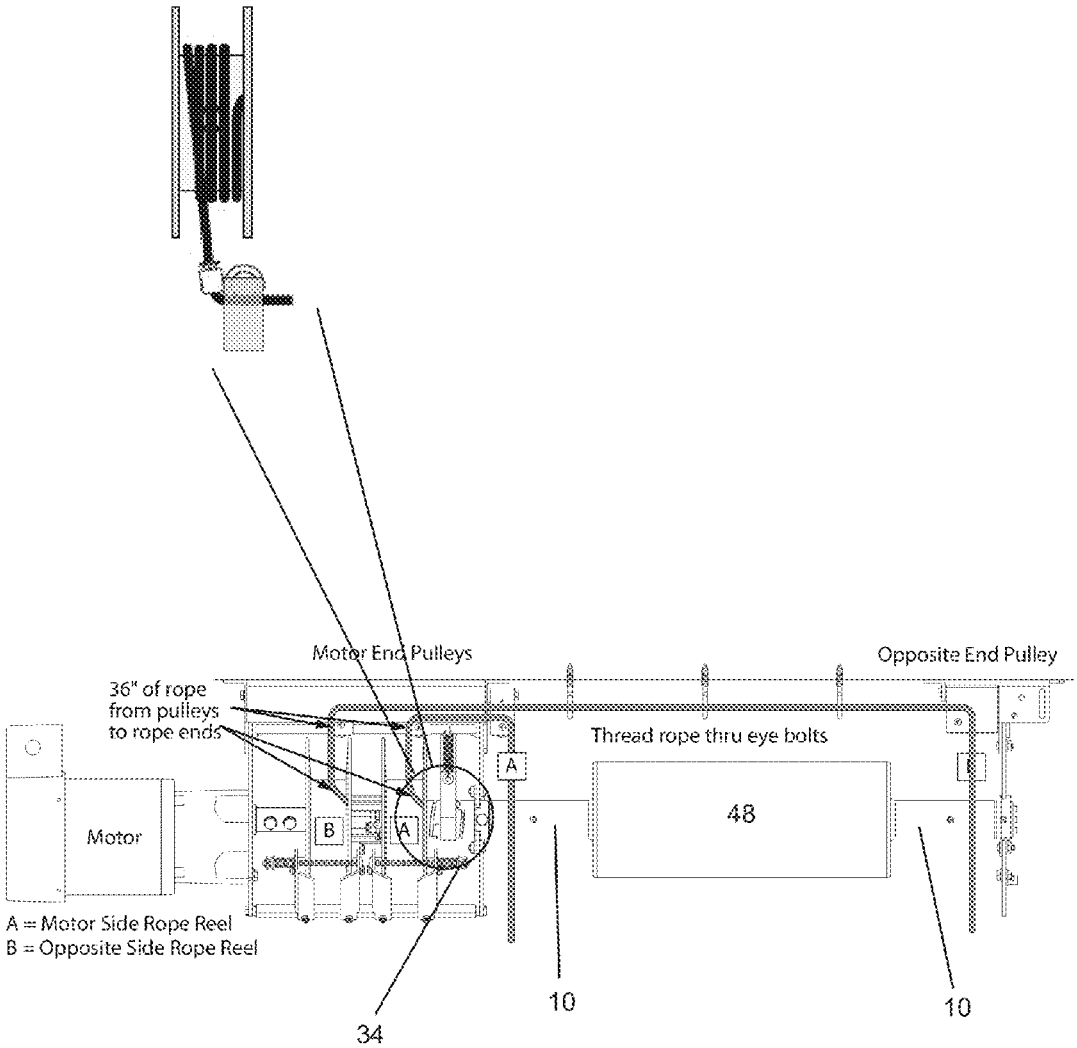
FIG. 10 shows a perspective view of how the system, including the rope reel, works in cooperation with the elements of the pool cover.

Another component used in connection with pool cover systems is a rope reel 34. In the past, these components have been made of cast aluminum as an integral component and then anodized and/or powder coated in an attempt to protect them from corrosion. However, corrosion has still been a problem with pool cover systems reels, and the present inventors have developed a solution. As shown in FIGS. 6 and 7, the rope reel 34 has two side plates 36, 38 which are separated by a polymer hub 40. The plates have a series of openings 42 therethrough, which correspond to openings 44 on the hub. In use, one or more fastening features 16 are positioned through an opening 42 of a first plate 36, through the hub opening 44, and through a corresponding opening 42 on the second plate 38. An optional nut 46 is then used to secure the fastening feature in place. By providing a rope reel 34 that is made of these three components (as opposed to a single one-piece cast item), corrosion can be minimized. As shown in FIG. 10, the rope reel cooperates with one or more ropes that are secured to a pool cover, such that winding of the rope reel can secure excess rope when the pool is uncovered. This Figure also illustrates the cooperation between the drum assembly 48 and the rope reel 34.

Changes and modifications, additions and deletions may be made to the structures and methods recited above and shown in the drawings without departing from the scope or spirit of the invention and the following claims.

What is claimed is:

1. An end hub assembly for a pool cover assembly, comprising:

a central plate;

at least one polymer hub secured to a first side of the central plate, the at least one polymer hub comprising at least one opening for receiving a fastener for securement to the central plate, a hub stem secured to a second side of the central plate; and a tube having an opening for receiving the at least one polymer hub.

2. The end hub assembly of claim 1, wherein the central plate comprises a stainless steel plate.

3. The end hub assembly of claim 1, wherein the central plate further comprises a series of openings therethrough, the openings configured to receive fastening features.

4. The end hub assembly of claim 1, further comprising four polymer hubs spaced near edges of the first side of the central plate.

5. The end hub assembly of claim 1, wherein the tube comprises a coated tube which cooperates with two end hub assemblies.

6. The end hub assembly of claim 1, wherein differently dimensioned central plates may be interchangeably secured to the hub stem.

7. A rope reel for a pool cover assembly, comprising at least first and second plates separated by at least one polymer hub, the at least one polymer hub comprising at least one opening for receiving a fastener for securement between the first and second plates, each of the first and second plates comprising at least one opening corresponding to the at least one opening of the polymer hub, and at least one fastener positioned through the at least one opening in the first plate, through the at least one opening of the polymer hub, and through the at least one opening in the second plate.

8. The rope reel of claim 7, wherein the at least two plates comprise stainless steel.

9. A pool cover assembly, comprising:

(a) a drum tube comprising one or more polyurethane coated ends;

(b) a hub assembly configured to be positioned within each end of the drum tube, the hub assembly comprising a plate having one or more polymer hubs extending from one side thereof and a hub stem extending from another side thereof, each of the one or more polymer hubs comprising at least one opening for receiving a fastener for securement to the plate; and (c) a rope reel comprising two separate plates separated by a polymer hub.

10. An end hub assembly for a pool cover assembly, comprising:

a central plate;

at least one polymer hub secured to a first side of the central plate, a hub stem secured to a second side of the central plate, and a coated tube which cooperates with two end hub assemblies.

11. The end hub assembly of claim 10, wherein the central plate comprises a stainless steel plate.

12. The end hub assembly of claim 10, wherein the central plate further comprises a series of openings therethrough, the openings configured to receive fastening features.

13. The end hub assembly of claim 10, further comprising four polymer hubs spaced near edges of the first side of the central plate.

14. The end hub assembly of claim 10, wherein differently dimensioned central plates may be interchangeably secured to the hub stem.

* * * * *